US011515642B2

(12) United States Patent
Koganti et al.

(10) Patent No.: US 11,515,642 B2
(45) Date of Patent: Nov. 29, 2022

(54) ANTENNA COVER WITH INTEGRATED STATIC LENS

(71) Applicant: ARRIS Enterprises LLC, Suwanee, GA (US)

(72) Inventors: Rajesh Koganti, Santa Clara, CA (US); Douglas Blake Kough, San Jose, CA (US)

(73) Assignee: ARRIS Enterprises LLC, Suwanee, GA (US)

( * ) Notice: Subject to any disclaimer, the term of this patent is extended or adjusted under 35 U.S.C. 154(b) by 0 days.

(21) Appl. No.: 17/202,443

(22) Filed: Mar. 16, 2021

(65) Prior Publication Data

US 2021/0296779 A1 Sep. 23, 2021

Related U.S. Application Data

(60) Provisional application No. 62/992,973, filed on Mar. 21, 2020.

(51) Int. Cl.

| | |
|---|---|
| ***H01Q 15/23*** | (2006.01) |
| ***H01Q 1/42*** | (2006.01) |
| ***H01Q 19/06*** | (2006.01) |
| ***H01Q 21/24*** | (2006.01) |
| ***H01Q 15/14*** | (2006.01) |
| ***H01Q 3/24*** | (2006.01) |
| ***H01Q 19/10*** | (2006.01) |

(52) U.S. Cl.

CPC ..... *H01Q 15/23* (2013.01); *H01Q 1/42* (2013.01); *H01Q 3/24* (2013.01); *H01Q 15/148* (2013.01); *H01Q 19/062* (2013.01); *H01Q 19/10* (2013.01); *H01Q 21/245* (2013.01)

(58) Field of Classification Search

CPC ..... H01Q 1/42; H01Q 15/02; H01Q 15/23; H01Q 15/148; H01Q 3/24; H01Q 19/062; H01Q 19/10; H01Q 21/245

See application file for complete search history.

(56) References Cited

U.S. PATENT DOCUMENTS

2005/0062660 A1* 3/2005 Henderson ..... H01Q 1/3283 343/754
2010/0283700 A1* 11/2010 Rajanish ..... H01L 24/48 343/793

FOREIGN PATENT DOCUMENTS

CN 101662076 A * 3/2010 ..... H01Q 15/08
EP 884799 A2 * 12/1998 ..... H01Q 23/00

* cited by examiner

*Primary Examiner* — Hoang V Nguyen
(74) *Attorney, Agent, or Firm* — Steven Stupp; Stewart Wiener

(57) ABSTRACT

An electronic device that communicates a packet or a frame is described. This electronic device includes: at least an antenna having an antenna radiation pattern; an interface circuit; and an antenna cover that includes an integrated static lens, where the antenna cover is selected from a set of antenna covers that includes different integrated static lenses. During operation, the interface circuit may transmit, from the antenna, wireless signals corresponding to the packet or the frame, where the integrated static lens modifies the antenna radiation pattern of the antenna. For example, the integrated static lens may cause the wireless signals to converge or diverge. Alternatively, the integrated static lens may change an angular elevation of the antenna radiation pattern and/or may provide a correction for pathloss as a function of angle. Note that the integrated static lens may be a stepwise approximation to a predefined function.

20 Claims, 8 Drawing Sheets

ANTENNA COVER WITH INTEGRATED STATIC LENS

CROSS REFERENCE TO RELATED APPLICATIONS

This application claims priority under 35 U.S.C. 119(e) to: U.S. Provisional Application Ser. No. 62/992,973, "Antenna Cover with Integrated Static Lens," filed on Mar. 21, 2020, by Rajesh Koganti, et al., the contents of which are herein incorporated by reference.

FIELD

The described embodiments relate to techniques for communication. Notably, the described embodiments relate to techniques for communicating using an antenna cover that includes an integrated static lens.

BACKGROUND

Many electronic devices are capable of wirelessly communicating with other electronic devices. For example, these electronic devices can include a networking subsystem that implements a network interface for a wireless local area network (WLAN), e.g., a wireless network such as described in the Institute of Electrical and Electronics Engineers (IEEE) 802.11 standard (which is sometimes referred to as 'Wi-Fi'). For example, a wireless network may include an access point that communicates wirelessly with one or more associated electronic devices (which are sometimes referred to as 'clients').

In many electronic devices, the antenna radiation patterns used to transmit or receive wireless signals are constrained by the available antennas or antenna elements. For example, in many indoor installations the antenna radiation patterns are typically monopole or dipole patterns. However, these antenna radiation patterns usually result in nearly equal antenna gain at angles or locations where this is unnecessary. Consequently, depending on the deployment geometry, the antenna radiation patterns may result in wasted antenna-pattern energy and, thus, in degraded communication performance.

SUMMARY

An electronic device that communicates a packet or a frame is described. This electronic device includes: at least an antenna having an antenna radiation pattern; an interface circuit communicatively coupled to the antenna; and an antenna cover that includes an integrated static lens, where the antenna cover is selected from a set of antenna covers that includes different integrated static lenses. During operation, the interface circuit transmits, from the antenna, wireless signals corresponding to the packet or the frame, where the integrated static lens modifies the antenna radiation pattern of the antenna.

Note that the antenna radiation pattern may be predefined. In some embodiments, the antenna radiation pattern may be dynamically adjusted. For example, the antenna radiation pattern may be selectively directed into one or more sectors in a horizontal plane. Notably, the antenna may include antenna elements that are selectively electrically coupled to ground to dynamically adjust the antenna radiation pattern. Alternatively or additionally, the electronic device may include directors (which are tuned to a higher frequency than the antenna or antenna elements) and/or reflectors (which are tuned to a lower frequency than the antenna or antenna elements) that are that are selectively electrically coupled to ground to dynamically adjust the antenna radiation pattern.

Moreover, the integrated static lens may cause the wireless signals to converge (e.g., in one or more sectors in the horizontal plane) or diverge (such as converting a directive antenna radiation pattern into an omnidirectional antenna radiation pattern). In some embodiments, the integrated static lens may change an angular elevation of the antenna radiation pattern.

Furthermore, the electronic device may include multiple antennas including the antenna (such as antennas associated with different bands of frequencies) or the antenna may include multiple antenna elements that are spatially distributed (i.e., at different locations or offset from each other in the electronic device), and the integrated static lens may provide a phase correction over the spatially distributed antennas or the antenna elements. Thus, the integrated static lens may spatially vary based at least in part on locations of the antennas or the antenna elements.

Additionally, the integrated static lens may provide a correction for pathloss as a function of angle, because at lower angles a recipient electronic device (such as a client) may, effectively, be further away from the electronic device. For example, the integrated static lens may correspond to a cosecant squared pattern.

In some embodiments, the integrated static lens may be a stepwise approximation to a predefined function (such as a Luneberg lens).

Note that the antenna may have a predefined polarization (or orientation of the electric field), such as in a horizontal direction, in a vertical direction, in a slant direction or circular polarization. Alternatively, the transmit polarization of the wireless signals may be dynamically adjusted. For example, the electronic device may include a reconfigurable antenna (which is sometimes referred to as a 'polarization flexible antenna'). Notably, the antenna may include multiple antennas or antenna elements having different predefined polarizations, and the interface circuit may dynamically select the antennas or the antenna elements to adjust the transmit polarization of the wireless signals. In some embodiments, the interface circuit dynamically adjusts the transmit polarization by changing a relative phase of electrical signals corresponding to the wireless signals (e.g., using a phase-modification element, such as a tapped delay line), which are used to drive the selected antennas or antenna elements. In some embodiments, the transmit polarization is dynamically adjusted based at least in part on feedback (such as an acknowledgment, throughput, a received signal strength indicator, a signal-to-noise ratio or, more generally, a communication-performance metric) associated with a second electronic device. This dynamic adjustment may be performed on the fly and/or may be performed on a device-specific basis.

Moreover, the interface circuit may receive, at the antenna, second wireless signals corresponding to a second packet or a second frame.

Furthermore, the antenna cover may be selected based at least in part on a deployment geometry of the electronic device.

Another embodiment provides the interface circuit.

Another embodiment provides a computer-readable storage medium with program instructions for use with the electronic device. When executed by the electronic device, the program instructions cause the electronic device to perform at least some of the aforementioned operations in one or more of the preceding embodiments.

Another embodiment provides a method, which may be performed by the electronic device. This method includes at least some of the aforementioned operations in one or more of the preceding embodiments.

This Summary is provided for purposes of illustrating some exemplary embodiments, so as to provide a basic understanding of some aspects of the subject matter described herein. Accordingly, it will be appreciated that the above-described features are examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE FIGURES

Note that like reference numerals refer to corresponding parts throughout the drawings. Moreover, multiple instances of the same part are designated by a common prefix separated from an instance number by a dash.

DETAILED DESCRIPTION

Figure 1:
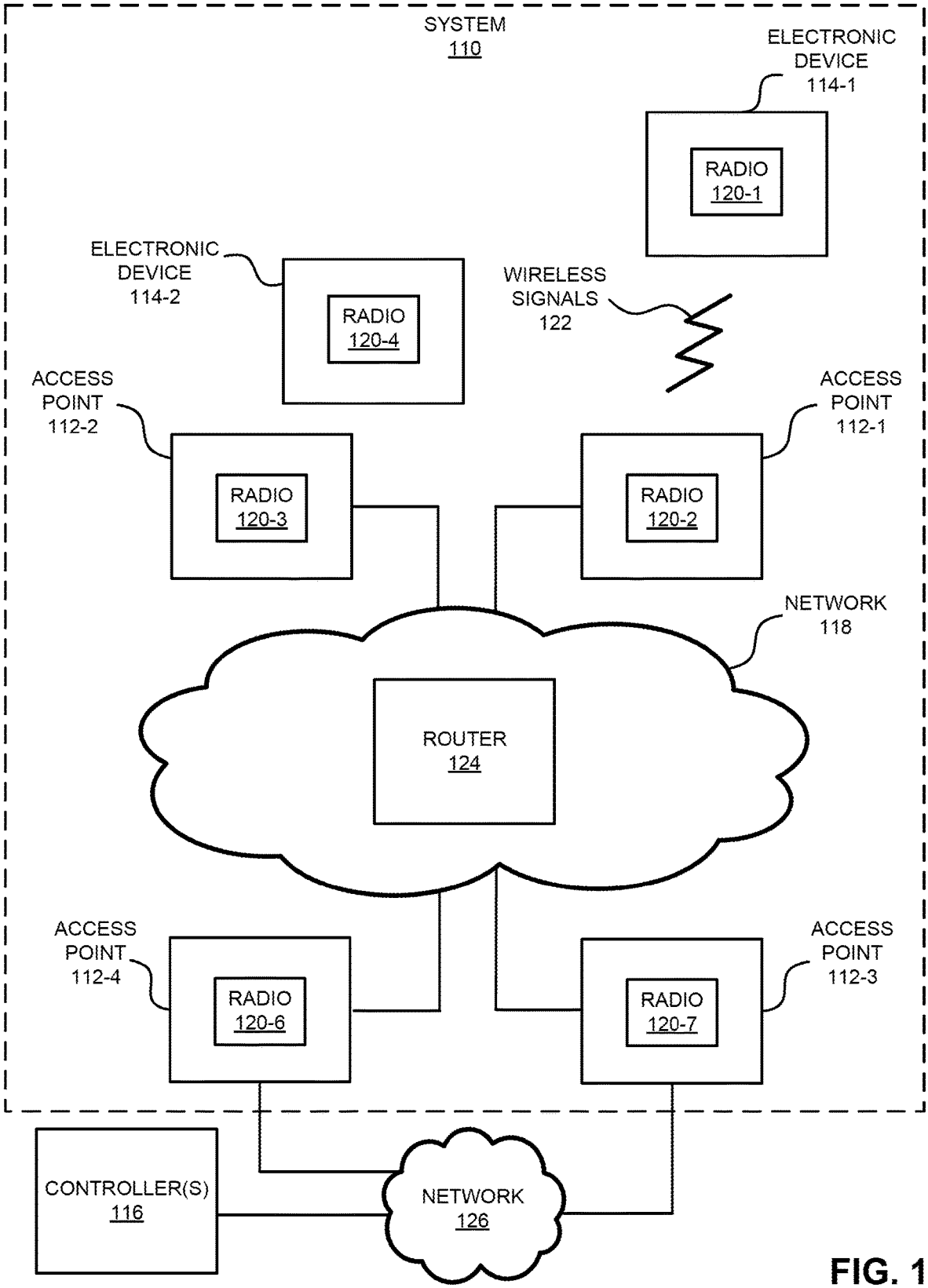
FIG. 1 is a block diagram illustrating an example of communication among electronic devices in accordance with an embodiment of the present disclosure.

An electronic device that communicates a packet or a frame is described. This electronic device includes: at least an antenna having an antenna radiation pattern; an interface circuit; and an antenna cover that includes an integrated static lens, where the antenna cover is selected from a set of antenna covers that includes different integrated static lenses. During operation, the interface circuit may transmit, from the antenna, wireless signals corresponding to the packet or the frame, where the integrated static lens modifies the antenna radiation pattern of the antenna. For example, the integrated static lens may cause the wireless signals to converge or diverge. Alternatively, the integrated static lens may change an angular elevation of the antenna radiation pattern and/or may provide a correction for pathloss as a function of angle. Note that the integrated static lens may be a stepwise approximation to a predefined function.

By modifying the antenna radiation pattern, these communication techniques may allow the electronic device to adapt the antenna to different environmental conditions. Notably, the antenna cover that includes the integrated static lens may be selected based at least in part on a deployment geometry, such as a location of the electronic device in an environment (such as a building) and the geometry of the surrounding environment proximate to the electronic device. For example, when the electronic device is positioned in the middle of a room, the antenna cover with the integrated static lens may be selected to modify the antenna radiation pattern so that it is omnidirectional. Alternatively, when the electronic device is positioned along a wall or near a corner, the antenna cover with the integrated static lens may be selected to modify the antenna radiation pattern so that it, respectively, covers half of a circle (i.e., from 0 to 180° from a plane defined by the ceiling) or one sector (i.e., from 0 to 90°). Moreover, when the electronic device is mounted on a ceiling, the antenna cover with the integrated static lens may be selected to modify the antenna radiation pattern so that an angular elevation of the antenna radiation pattern is directed or pointed towards the floor in a room (such as an angular elevation of 5-10°). Thus, the additional degree of freedom provided by the integrated static lens may allow the antenna radiation pattern to be modified or shaped in order to improve or optimize the use of the antenna-pattern energy. Consequently, the communication techniques may improve (or optimize) the communication performance (such as the throughput) with the second electronic device, and therefore may improve the user experience when using the electronic device or the second electronic device.

In the discussion that follows, electronic devices or components in a system communicate packets in accordance with a wireless communication protocol, such as: a wireless communication protocol that is compatible with an IEEE 802.11 standard (which is sometimes referred to as WiFi®, from the Wi-Fi Alliance of Austin, Tex.), Bluetooth® (from the Bluetooth Special Interest Group of Kirkland, Wash.), and/or another type of wireless interface (such as another wireless-local-area-network interface). For example, an IEEE 802.11 standard may include one or more of: IEEE 802.11a, IEEE 802.11b, IEEE 802.11g, IEEE 802.11-2007, IEEE 802.11n, IEEE 802.11-2012, IEEE 802.11-2016, IEEE 802.11ac, IEEE 802.11ax, IEEE 802.11ba, or other present or future developed IEEE 802.11 technologies. Moreover, an access point in the system may communicate with a controller or services using a wired communication protocol, such as a wired communication protocol that is compatible with an Institute of Electrical and Electronics Engineers (IEEE) 802.3 standard (which is sometimes referred to as 'Ethernet'), e.g., an Ethernet II standard. However, a wide variety of communication protocols may be used in the system, including wired and/or wireless communication. In the discussion that follows, Ethernet and Wi-Fi are used as illustrative examples.

We now describe some embodiments of the communication techniques. FIG. 1 presents a block diagram illustrating an example of a system 110, which may include components, such as: one or more access points 112, one or more electronic devices 114 (such as cellular telephones, stations, another type of electronic device, etc.), and one or more optional controllers 116. In system 110, the one or more access points 112 may wirelessly communicate with the one or more electronic devices 114 using wireless communication that is compatible with an IEEE 802.11 standard. Thus, the wireless communication may occur in a 2.4 GHz, a 5 GHz, a 6 GHz and/or a 60 GHz frequency band. (Note that IEEE 802.11ad communication over a 60 GHz frequency band is sometimes referred to as 'WiGig.' In the present discussion, these embodiments also encompassed by 'Wi-Fi.') However, a wide variety of frequency bands may be used.

Moreover, wired and/or wireless communication among access points 112 in a WLAN may occur via network 118 (such as an intra-net, a mesh network, point-to-point connections and/or the Internet) and may use a network communication protocol, such as Ethernet. This network may include one or more routers and/or switches, such as router 124.

As noted previously, the one or more access points 112 and the one or more electronic devices 114 may communicate via wireless communication. Notably, one or more of access points 112 and one or more of electronic devices 114 may wirelessly communicate while: transmitting advertising frames on wireless channels, detecting one another by scanning wireless channels, exchanging subsequent data/management frames (such as association requests and responses) to establish a connection, configure security options (e.g., Internet Protocol Security), transmit and receive frames or packets via the connection (which may include the association requests and/or additional information as payloads), etc.

In some embodiments, the wired and/or wireless communication among access points 112 also involves the use of dedicated connections, such as via a peer-to-peer (P2P) communication technique. Therefore, access points 112 may support wired communication within the WLAN (such as Ethernet) and wireless communication within the WLAN (such as Wi-Fi), and one or more of access points 112 may also support a wired communication protocol (such as Ethernet) for communicating via network 126 (such as the Internet) with other electronic devices, such as a computer or the one or more optional controllers 116 of the WLAN. Note that the one or more optional controllers 116 may be at the same location as the other components in system 110 or may be located remotely (i.e., at a different location). Moreover, note that the one or more access points 112 may be managed by the one or more optional controllers 116. Furthermore, note that the one or more access points 112 may be a physical access point or a virtual or 'software' access point that is implemented on a computer or an electronic device.

Figure 8:
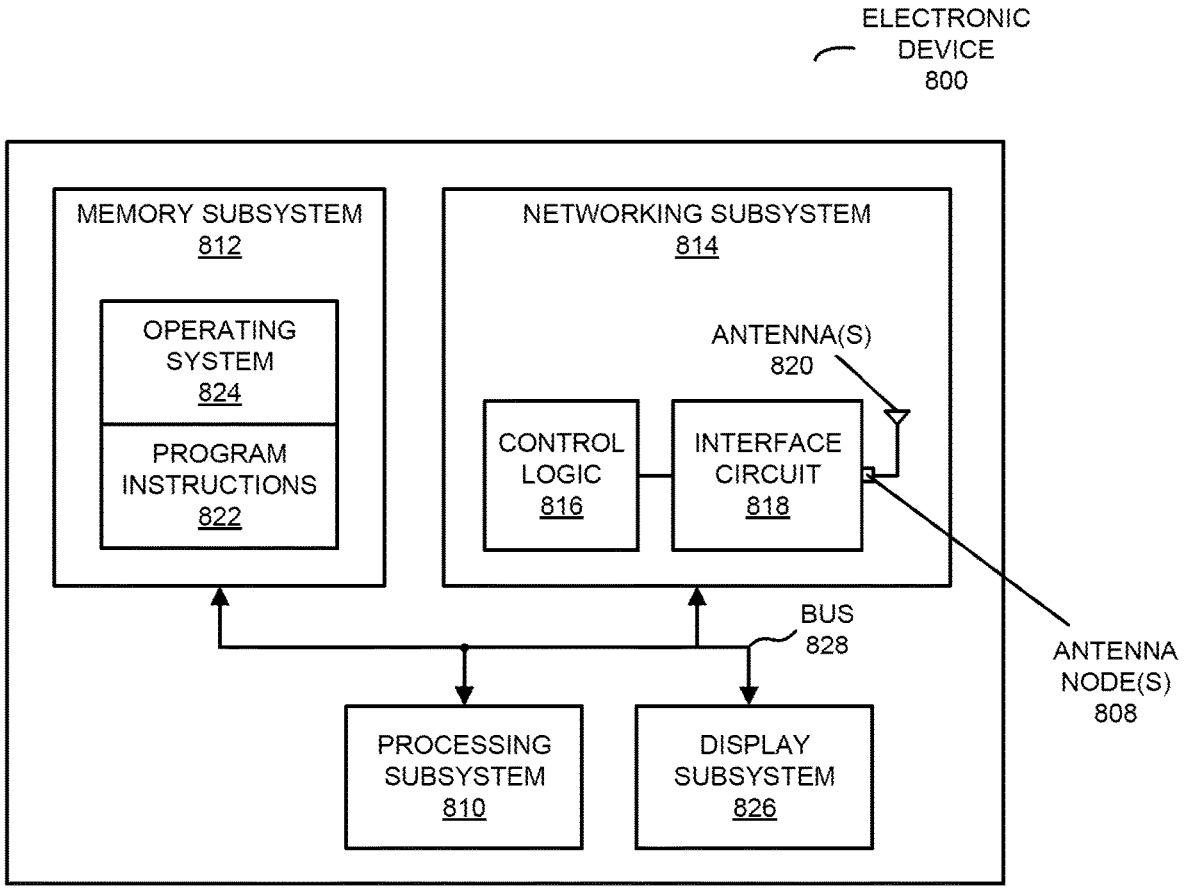
FIG. 8 is a block diagram illustrating an example of an electronic device in accordance with an embodiment of the present disclosure.

As described further below with reference to FIG. 8, the one or more access points 112, the one or more electronic devices 114 and/or the one or more optional controllers 116 may include subsystems, such as a networking subsystem, a memory subsystem and a processor subsystem. In addition, the one or more access points 112 and the one or more electronic devices 114 may include radios 120 in the networking subsystems. More generally, the one or more access points 112 and the one or more electronic devices 114 can include (or can be included within) any electronic devices with the networking subsystems that enable the one or more access points 112 and the one or more electronic devices 114 to wirelessly communicate with each other.

As can be seen in FIG. 1, wireless signals 122 (represented by a jagged line) are transmitted from a radio 120-2 in at least one of the one or more access points 112, such as access point 112-1. These wireless signals are received by radio 120-1 in electronic device 114-1. In particular, access point 112-1 may transmit frames or packets. In turn, these frames or packets may be received by electronic device 114-1. This may allow access point 112-1 to communicate information to electronic device 114-1. Note that the communication between electronic device 114-1 and access point 112-1 may be characterized by a variety of performance metrics, such as: a data rate, a data rate for successful communication (which is sometimes referred to as a 'throughput'), an error rate (such as a retry or resend rate), a mean-square error of equalized signals relative to an equalization target, intersymbol interference, multipath interference, a signal-to-noise ratio, a width of an eye pattern, a ratio of number of bytes successfully communicated during a time interval (such as 1-10 s) to an estimated maximum number of bytes that can be communicated in the time interval (the latter of which is sometimes referred to as the 'capacity' of a communication channel or link), and/or a ratio of an actual data rate to an estimated data rate (which is sometimes referred to as 'utilization'). While instances of radios 120 are shown in the one or more electronic devices 114 and the one or more access points 112, one or more of these instances may be different from the other instances of radios 120.

As noted previously, the antenna radiation patterns used to transmit or receive wireless signals are often constrained by the available antennas or antenna elements. However, these antenna radiation patterns may not be well suited for a particular location or environment where an electronic device is deployed. This can result in wasted antenna-pattern energy and, thus, in degraded communication performance.

In order to address this challenge, the one or more access points 112 (such as access point 112-1) may implement or use the communication techniques. Notably, as discussed further below with reference to FIGS. 2-7, during the communication techniques access point 112-1 may communicate a packet or a frame (e.g., to electronic device 114-1) using wireless signals. The wireless signals may be transmitted by an antenna in access point 112-1 that has an antenna radiation pattern. Alternatively, access point 112-1 may receive wireless signals corresponding to a packet or a frame (e.g., from electronic device 114-1).

Note that the antenna radiation pattern may be predefined or static. However, in some embodiments, the antenna radiation pattern may be dynamically adjusted. For example, the antenna radiation pattern may be selectively directed into one or more sectors in a horizontal plane that may be parallel to a floor in the environment (e.g., between 0 and 90° or 0 and 180°). Notably, as described further below with reference to FIG. 6, the antenna may include antenna elements that are selectively electrically coupled to ground by radio 120-2 to dynamically adjust the antenna radiation pattern. Alternatively or additionally, access point 112-1 may include directors (which are tuned to a higher frequency than the antenna or antenna elements) and/or reflectors (which are tuned to a lower frequency than the antenna or antenna elements) that are selectively electrically coupled to ground by radio 120-2 to dynamically adjust the antenna radiation pattern.

Moreover, access point 112-1 may have an antenna cover (which is sometimes referred to as an 'antenna radome,' an 'aperture cover,' 'an aperture radome,' or an 'antenna housing') that includes an integrated predefined or static lens. Note that the antenna cover may be selected from a set of antenna covers that includes different integrated static lenses. For example, the antenna cover may be selected based at least in part on a deployment geometry of access point 112-1. When radio 120-2 transmits (or receives) the wireless signals, the integrated static lens may modify the antenna radiation pattern of the antenna. Notably, the integrated static lens may cause the wireless signals to converge (e.g., in one or more sectors in the horizontal plane) or diverge (such as converting a directive antenna radiation pattern into an omnidirectional antenna radiation pattern).

Alternatively or additionally, the integrated static lens may change an angular elevation of the antenna radiation pattern (such as by directing the antenna radiation pattern towards the floor in a room, e.g., at an angular elevation of 5-10° with respect to a plane defined by a ceiling on which the access point may be mounted).

Figure 5:
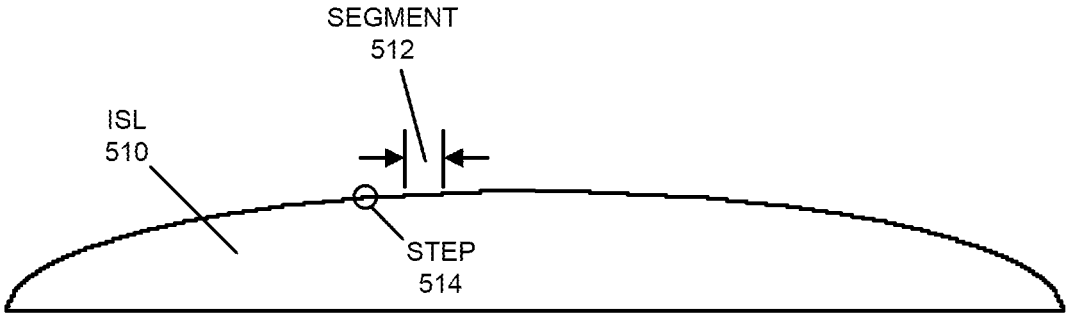
FIG. 5 is a drawing illustrating an example of an integrated static lens that is a stepwise approximation to a predefined function in accordance with an embodiment of the present disclosure.

Furthermore, the integrated static lens may provide a correction for pathloss as a function of angle, because at lower angles an electronic device (such as electronic device 114-1) may, effectively, be further away from access point 112-1. For example, the integrated static lens may correspond to a cosecant squared pattern (or, equivalently, an inverse sine squared pattern). This may provide approximately a constant power at different distances from access point 112-1. Additionally, as shown in FIG. 5, the integrated static lens may be a stepwise approximation to a predefined function (such as a Luneberg lens), with multiple stacked layers and at least two of the layers may have different dielectric constants.

In some embodiments, access point 112-1 may include multiple antennas (such as antennas associated with or operating in different bands of frequencies, e.g., a 2.4 GHz band of frequencies and a 5 GHz band of frequencies) or multiple antenna elements that are spatially distributed (i.e., at different locations or offset from each other in access point 112-1). In these embodiments, because there is not a single aperture, the integrated static lens may provide a phase correction over the spatially distributed antennas or the antenna elements. Thus, the integrated static lens may spatially vary based at least in part on locations of the antennas or the antenna elements in access point 112-1. Note that in some embodiments, access point 112-1 may communicate the packet or the frame using MIMO. For example, access point 112-1 may use 2×2, 4×4, 8×8, 16×16 or N×N (where N is an integer) MIMO.

Moreover, the antenna may have a predefined polarization (or orientation of the electric field), such as in a horizontal direction, in a vertical direction, in a slant direction or circular polarization. However, in some embodiments, the transmit and/or receive polarization of the wireless signals may be dynamically adjusted. For example, access point 112-1 may include a reconfigurable antenna (which is sometimes referred to as a 'polarization flexible antenna'). Notably, the antenna may include multiple antennas or antenna elements having different predefined polarizations, and radio 120-2 may dynamically select or use one or more of the antennas or the antenna elements to adjust the transmit and/or receive polarization of the wireless signals. In some embodiments, radio 120-2 dynamically adjusts the transmit or receive polarization by changing a relative magnitude and/or phase of electrical signals corresponding to the wireless signals (e.g., using a filter, such as an attenuator, and/or a phase-modification element, such as a tapped delay line, between radio 120-2 and the antennas and/or antenna elements), which, for transmission, are used to drive the selected antennas or antenna elements, or which, for reception, are received by antennas or antenna elements.

In some embodiments, the transmit and/or receive polarization is dynamically adjusted based at least in part on feedback (such as an acknowledgment, information specifying a throughput, information specifying a received signal strength indicator, information specifying a signal-to-noise ratio or, more generally, a communication-performance metric) associated with electronic device 114-1. Note that the dynamic adjustment may be performed on the fly and/or may be performed on a device-specific basis (such as for electronic device 114-1). Consequently, access point 112-1 may use an arbitrary polarization (linear, e.g., horizontal, vertical or any slant, circular or elliptical) to transmit and/or receive a packet or a frame.

In this way, the communication techniques may allow different antenna radiation patterns to be obtained even with a set of available antenna(s) and/or antenna element(s). Moreover, the communication techniques may allow the antenna radiation pattern of access point 112-1 to be customized to a particular environment or deployment geometry. Consequently, the communication techniques may improve (or optimize) the communication performance (such as the throughput) with electronic device 114-1, and therefore may improve the user experience in system 110.

In the described embodiments, processing a frame or a packet in the electronic devices and/or the one or more access points may include: receiving wireless signals 122 with the frame or packet; decoding/extracting the frame or packet from the received wireless signals 122 to acquire the frame or packet; and processing the frame or packet to determine information contained in the frame or packet.

Although we describe the network environment shown in FIG. 1 as an example, in alternative embodiments, different numbers or types of electronic devices or components may be present. For example, some embodiments comprise more or fewer electronic devices or components. Therefore, in some embodiments there may be fewer or additional instances of at least some of the one or more access points 112, the one or more electronic devices 114, and/or the one or more optional controllers 116. As another example, in another embodiment, different electronic devices are transmitting and/or receiving frames or packets.

Figure 2:
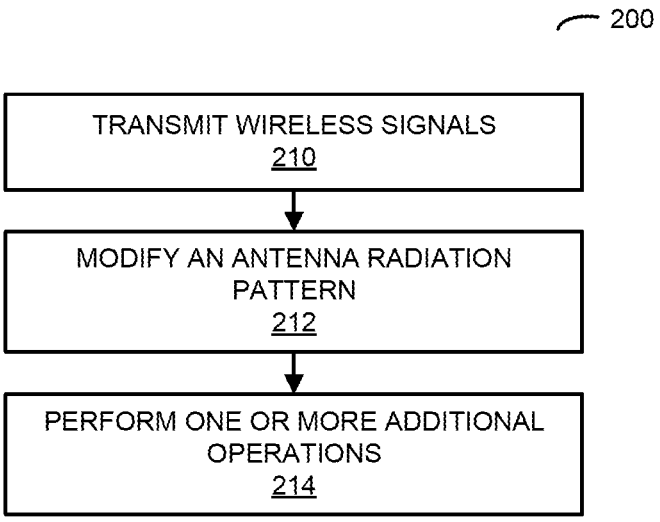
FIG. 2 is a flow diagram illustrating an example of a method for communicating a packet or a frame in accordance with an embodiment of the present disclosure.

We now describe embodiments of the method. FIG. 2 presents a flow diagram illustrating an example of a method 200 for communicating a packet or a frame. Moreover, method 200 may be performed by an electronic device, such as one of the one or more access points 112 in FIG. 1, e.g., access point 112-1. During operation, the electronic device may transmit, from an antenna in the electronic device, wireless signals (operation 210) corresponding to the packet or the frame. Then, the electronic device may modify, using an integrated static lens in an antenna cover in the electronic device, an antenna radiation pattern (operation 212) of the antenna, where the antenna cover is selected from a set of antenna covers that include different integrated static lenses.

In some embodiments, the electronic device optionally performs one or more additional operations (operation 214). For example, electronic device may receive, at an antenna in the electronic device, wireless signals corresponding to another packet or another frame Note that the integrated static lens may cause the wireless signals to converge or diverge. In some embodiments, the integrated static lens may change an angular elevation of the antenna radiation pattern.

Moreover, the electronic device may include multiple antennas including the antenna or the antenna may include multiple antenna elements that are spatially distributed (i.e., at different locations or offset from each other in the electronic device), and the integrated static lens may provide a phase correction over the spatially distributed antennas or the antenna elements. Thus, the integrated static lens may spatially vary based at least in part on locations of the antennas or the antenna elements.

Furthermore, the integrated static lens may provide a correction for pathloss as a function of angle, because at lower angles a recipient electronic device (such as a client) may, effectively, be further away from the electronic device. For example, the integrated static lens may correspond to a cosecant squared pattern. Additionally, the integrated static lens may be a stepwise approximation to a predefined function.

In some embodiments of method 200, there may be additional or fewer operations. Moreover, the order of the operations may be changed, and/or two or more operations may be combined into a single operation.

Figure 3:
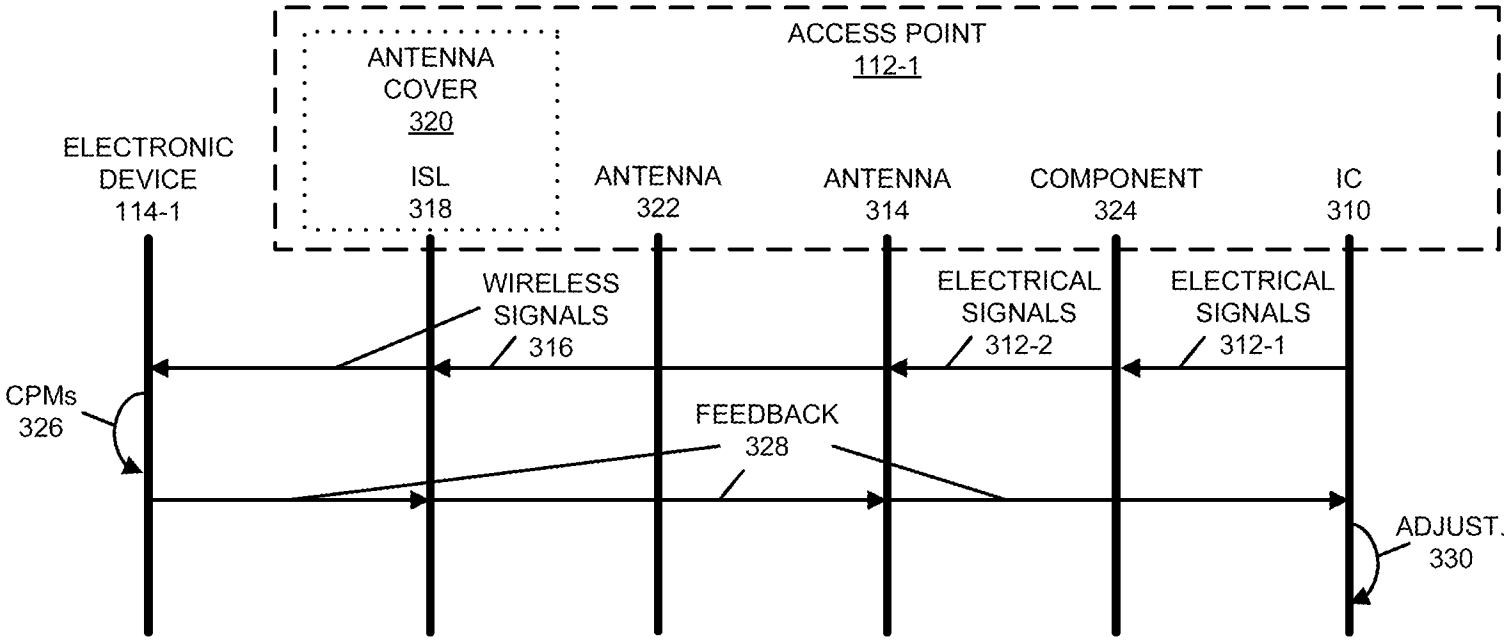
FIG. 3 is a drawing illustrating an example of communication among components in an electronic device in FIG. 1 in accordance with an embodiment of the present disclosure.

Embodiments of the communication techniques are further illustrated in FIG. 3, which presents a drawing illustrating an example of communication between access point 112-1 and electronic device 114-1 according to some embodiments. Notably, interface circuit 310 in access point 112-1 may provide electrical signals 312 corresponding to a packet or a frame to antenna 314 that has an antenna radiation pattern, and which transmits corresponding wireless signals 316.

Then, an integrated static lens (ISL) 318 in an antenna cover 320 in access point 112-1 may modify the antenna radiation pattern of antenna 314, where antenna cover 320 is selected from a set of antenna covers that include different integrated static lenses. For example, integrated static lens 318 may include one or more metal and/or dielectric layers that modify the antenna radiation pattern. In some embodiments, the dielectric layers may have a dielectric constant of at least 1.5, 1.7, 1.9, 2.1, 2.3 or 2.5. Note that antenna cover 320 may be selected based at least in part on a deployment geometry or environment of access point 112-1.

In some embodiments, interface circuit 310 may dynamically adjust or change the antenna radiation pattern of an antenna (such as antenna 314) and/or a polarization of wireless signals 316. For example, interface circuit 310 may provide control signals that selectively electrically couple one or more components (such as an antenna element, a director or a reflector) to ground (such as by forward biasing a PIN diode). Alternatively or additionally, interface circuit 310 may discontinue transmitting using antenna 314 that has a first predefined polarization (such as a horizontal polarization) and may transmit using an antenna 322 that has a second predefined polarization (such as a vertical polarization), or interface circuit 310 may transmit wireless signals 316 using antennas 314 and 322. Furthermore, interface circuit 310 may change a relative magnitude and/or a relative phase of electrical signals 312 that drive antennas 314 and 322, e.g., by providing one or more control signals to a component 324 (such as a filter, such as an attenuator, and/or a phase-modification element) between interface circuit 310 and antennas 314 and/or 322.

Note that the dynamic adjustment of the antenna radiation pattern and/or the polarization may be based at least in part on feedback 328 from electronic device 114-1. Notably, after receiving wireless signals 316, electronic device 114-1 may determine one or more communication-performance metrics (CPMs) 326 and then may provide feedback 328 to access point 112-1. This feedback may include an acknowledgment and/or information that specifies the one or more communication-performance metrics (such as a received signal strength, a throughput, etc.). After receiving feedback 328, interface circuit 310 may determine an adjustment 330 to the antenna radiation pattern and/or the polarization.

While not shown in FIG. 3, electronic device 114-1 may transmit another packet or another frame to access point 112-1. Wireless signals corresponding to the other packet or frame may be received by interface circuit 310. In some embodiments, interface circuit 310 may dynamically modify an antenna radiation pattern (such as of antenna 314) and/or the polarization of the wireless signals. Note that these modifications or adjustments may be based at least in part on one or more communication-performance metrics associated with the communication of the other packet or the other frame, such as one or more communication-performance metrics determined by interface circuit 310.

Moreover, while FIG. 3 illustrates communication between components using unidirectional or bidirectional communication with lines having single arrows or double arrows, in general the communication in a given operation in this figure may involve unidirectional or bidirectional communication.

In some embodiments of the communication techniques, an access point may expand the antenna design to the antenna (or aperture) cover or radome where it is possible to perform additional antenna-radiation pattern shaping. For example, the antenna cover may include an integrated static lens. This additional capability may allow a phase adjustment on antenna arrays or the creation of antenna-radiation patterns that are more suited to the deployed environment.

In some embodiments, the integrated static lens may help maintain an antenna gain that is consistent with the free-space spreading loss, such as a cosecant squared pattern. Alternatively or additionally, the combination of an antenna radiation pattern and the integrated static lens (such as the lensing associated with the four straight sides of the antenna cover) may result in a 'lobed' type of pattern. This may cause the antenna-pattern energy to be more directive in the lens sector. For example, it may be desirable to focus the transmitted (and received) RF energy in one or two directions, which may allow the antenna radiation pattern to be directed differently for a corner in a room versus the center of the room.

Note that the integrated static lens may be implemented by including metal, a dielectric or both in the antenna cover, and/or by changing a thickness of the antenna cover over a cross section of the antenna cover. In some embodiments, the dielectric in the integrated static lens may have a dielectric constant of at least 1.5, 1.7, 1.9, 2.1, 2.3 or 2.5.

Thus, in some embodiments, the integrated static lens may: shape the antenna radiation pattern in an azimuth (or horizontal) direction; shape the antenna radiation pattern in an elevation or vertical direction (which may allow the antenna radiation pattern to compensate for pathloss as a function of angle, because at lower angles a recipient electronic device may, effectively, be further away from the electronic device); provide phase adjustments to antennas (such as a sector array); provide a divergence lens to spread the antenna-pattern energy (such as a fan beam or a similar spread antenna-pattern shape); or to provide a convergence lens to narrow the antenna radiation pattern in a particular direction.

Figure 4:
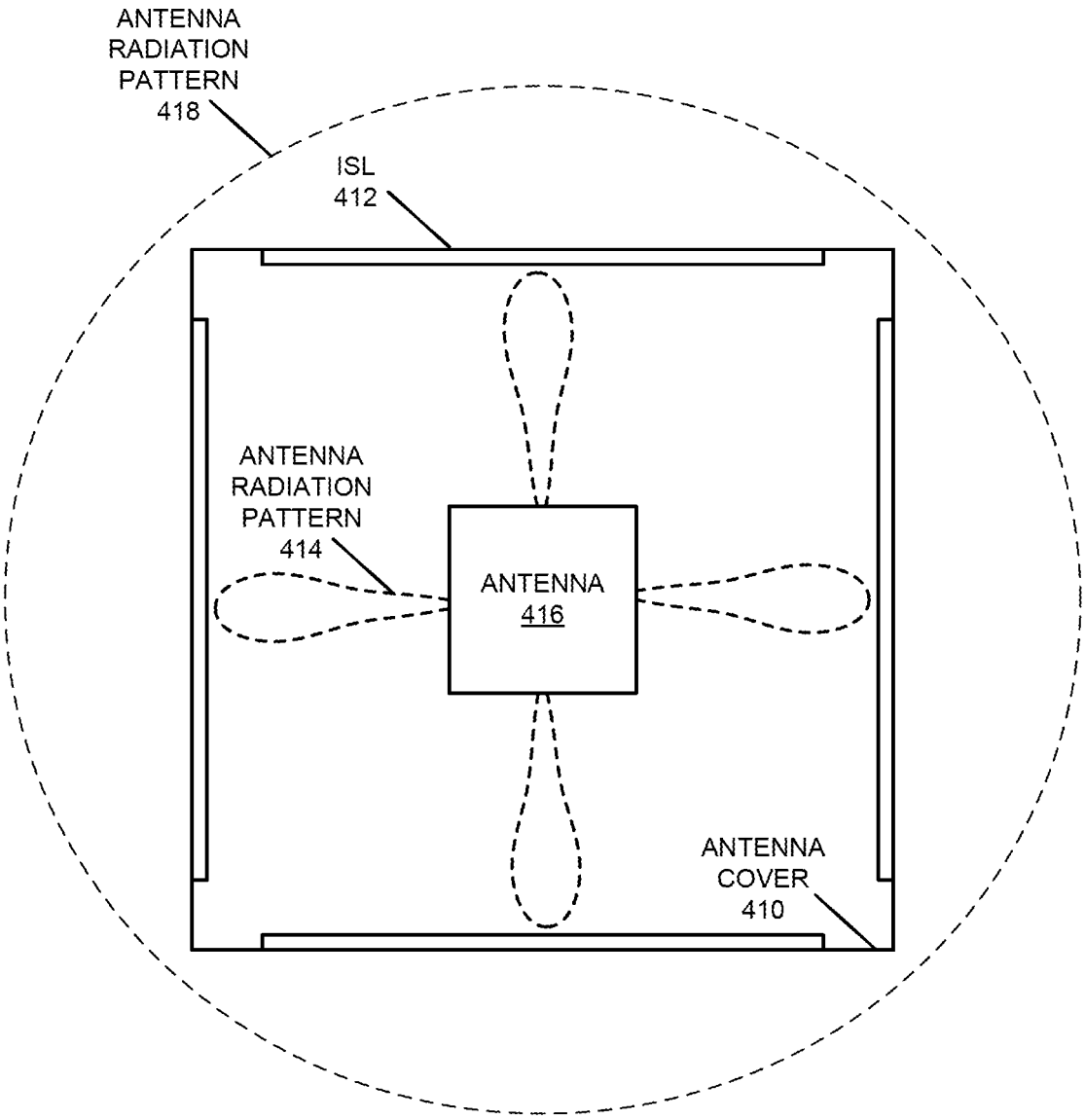
FIG. 4 is a drawing illustrating an example of an antenna cover or radome with an integrated static lens in accordance with an embodiment of the present disclosure.

FIG. 4 presents a drawing illustrating an example of an antenna (or aperture) cover 410 or radome with an integrated static lens 412. This integrated static lens may shape an original antenna radiation pattern 414 of an antenna 416 into an omnidirectional antenna radiation pattern 418.

FIG. 5 presents a drawing illustrating an example of an integrated static lens 510 that is a stepwise approximation to a predefined function. Notably, integrated static lens 510 may include segments (such as segment 512) with set of steps (such as step 514) that approximate the predefined function.

Figure 6:
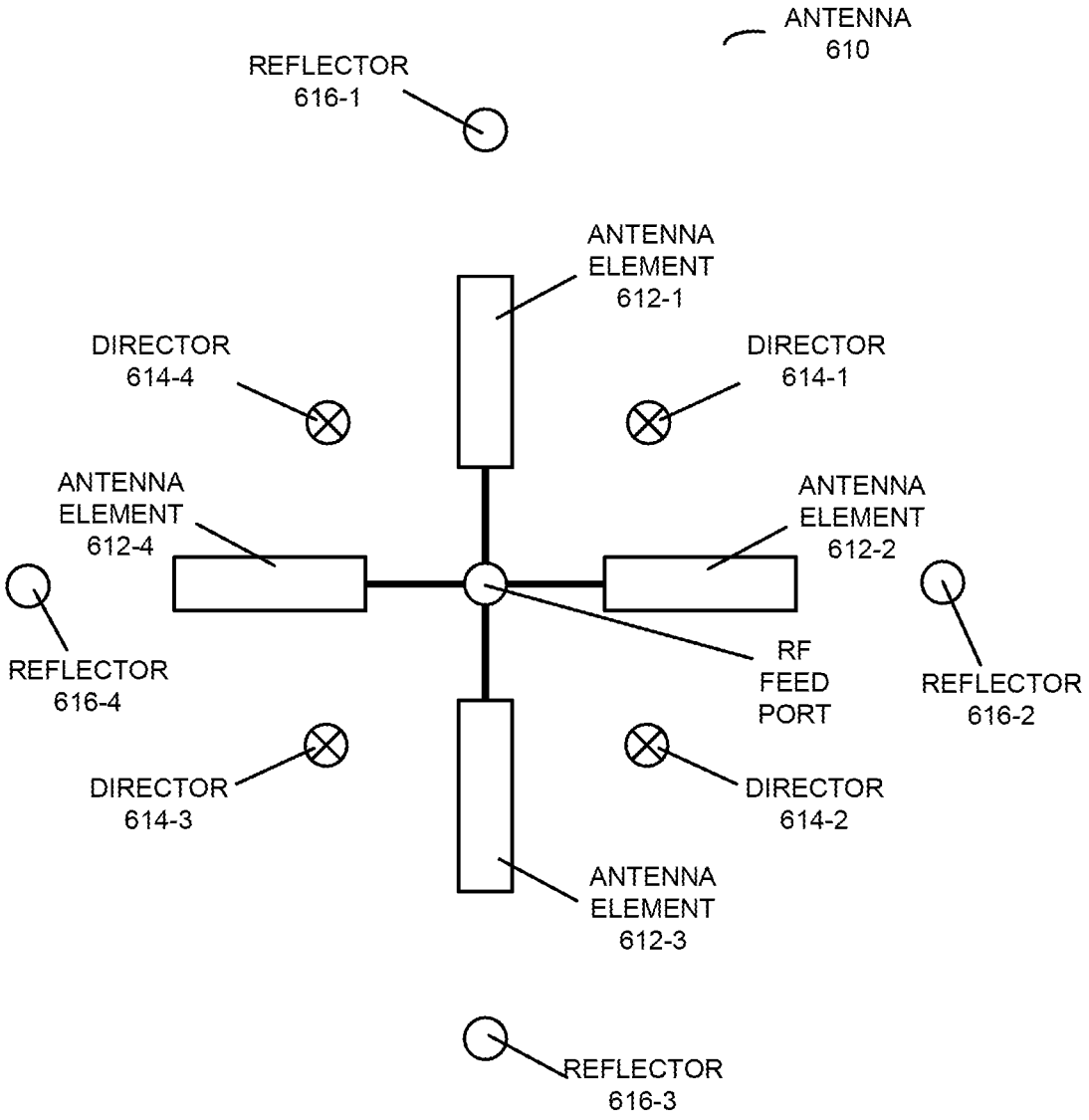
FIG. 6 is a drawing illustrating an example of an antenna having a dynamically adjustable antenna radiation pattern in accordance with an embodiment of the present disclosure.

FIG. 6 presents a drawing illustrating an example of an antenna 610 having a dynamically adjustable antenna radiation pattern. Notably, a transceiver may selectively provide electrical signals to one or more antenna elements 612, directors 614 and/or reflectors 616 in order to change or adjust the antenna radiation pattern. For example, the antenna radiation pattern may be dynamically changed or adjusted by selectively electrically coupling one or more antenna elements 612, directors 614 and/or reflectors 616 to ground.

For example, a given antenna may optionally include multiple antenna elements, such a dipoles (e.g., a bent dipole). In some embodiments, these antenna elements are implemented on a substrate. Moreover, an access point may include an antenna element selector (such as a radio-frequency switch, e.g., a single-pole, single-throw switch) that selectively couples the transceiver (or an associated radio-frequency feed port) to one or more of the antenna elements 612. Furthermore, the given antenna may optionally include one or more passive components, such as one or more directors 614 and/or one or more reflectors 616. Thus, the given antenna may include a Yagi-uda antenna.

Note that a director may be tuned to a slightly higher frequency than a given antenna element, may be electrically decoupled from the given antenna element, and may be selectively coupled to the ground plane via a PIN diode, a GaAs FET, a MEMS switch, or another radio-frequency switch. When a control signal from an interface circuit or a transceiver forward biases the PIN diode, the director may be coupled to ground and the director may not modify the antenna radiation pattern of the given antenna element appreciably. Alternatively, when the control signal reverse biases the PIN diode, the director may be decoupled from ground and may re-radiate the wireless signals from the given antenna element, which may make the antenna radiation pattern more directional. For example, a director may provide 1-2 dB of gain for the given antenna element.

Additionally, a reflector may be tuned to a slightly lower frequency than the given antenna element, may be electrically decoupled from the given antenna element, and may be selectively coupled to the ground plane via a PIN diode or a radio-frequency switch. When the PIN diode is forward biased, the reflector may be coupled to ground and the reflector may reflect the wireless signals from the given antenna element, thereby making the antenna radiation pattern more directional. Alternatively, when the PIN diode is reversed biased, the reflector may be decoupled from ground and may not modify the antenna radiation pattern of the given antenna element appreciably.

In some embodiments, the antenna radiation pattern of antenna 610 is dynamically varied or changed between an omnidirectional radiation pattern and a directional radiation pattern (which has gain in a particular direction relative to an omnidirectional radiation pattern, e.g., a cardioid directional radiation pattern).

Thus, by selecting particular antenna element(s) 612 and selectively activating (or deactivating) the one or more directors 614 and/or the one or more reflectors 616, the antenna radiation pattern of a given antenna may be varied from directional to omnidirectional. The ability to vary the antenna radiation pattern may allow an access point to configure the radio-frequency energy hitting the integrated static lens the antenna cover.

Figure 7:
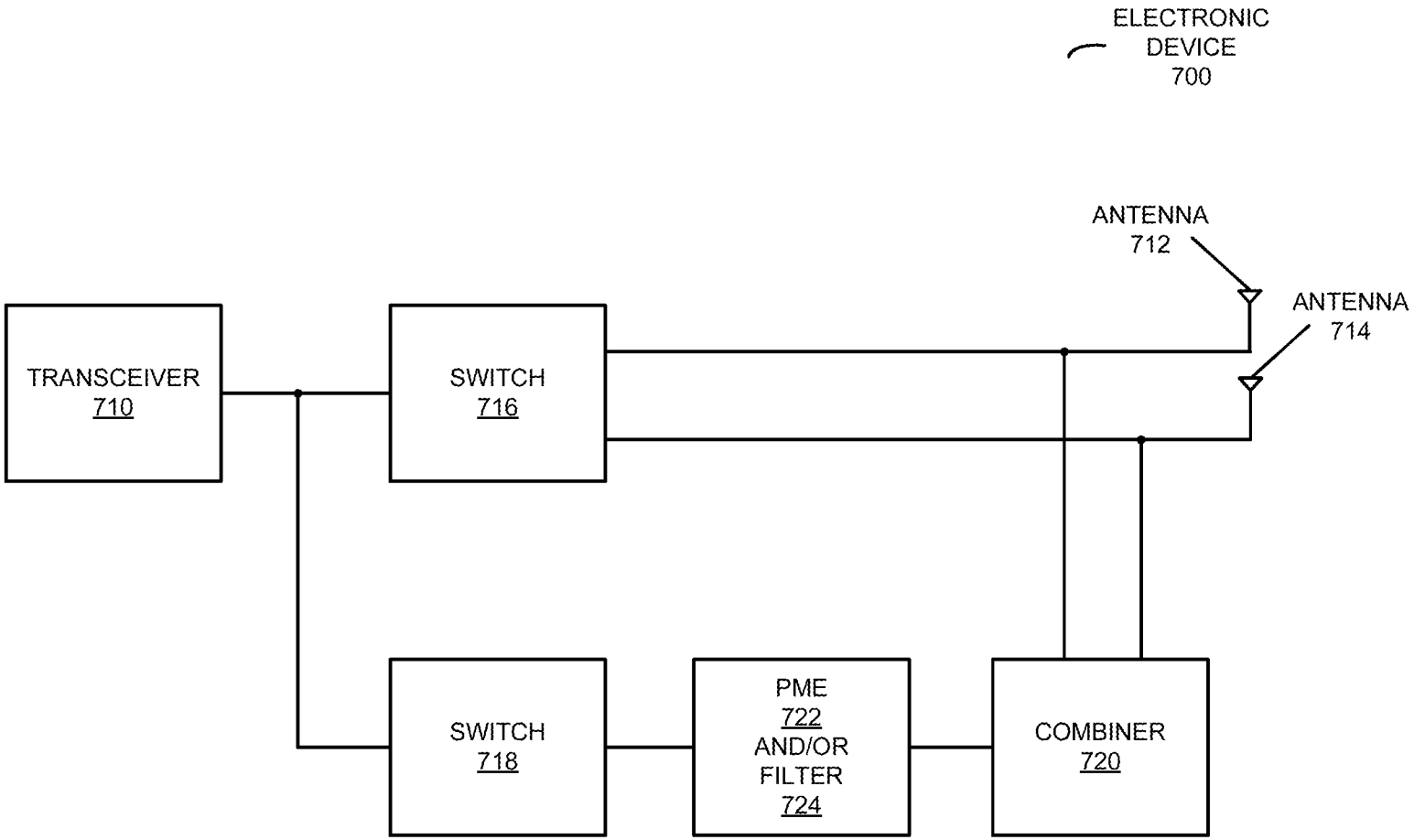
FIG. 7 is a drawing illustrating an example of an electronic device having an adjustable polarization in accordance with an embodiment of the present disclosure.

FIG. 7 presents a drawing illustrating an example of an electronic device 700 having an adjustable polarization. Notably, electronic device 700 may include a transceiver 710, and antennas 712 and 714. During operation, transceiver 710 may selectively provide electrical signals to antennas 712 and/or 714 via switch 716 or switch 718 and combiner 720. In some embodiments, switch 716 may selectively provide electrical signals to either antenna 712 or 714. Alternatively, switch 718 and combiner 720 may selectively provide electrical signals to both of antennas 712 and 714. Moreover, transceiver 710 may provide control signals to a phase-modification element (PME) 722 and/or a filter 724 (such as an attenuator), thereby changing a relative magnitude and/or relative phase of electrical signals to antennas 712 and 714. In these ways, the selected antennas 712 and/or 714 may transmit wireless signals having an arbitrary net polarization.

While FIG. 7 illustrates transmission, a similar configuration may be used during receiving. In some embodiments, a pair of antennas having predefined polarizations may be used for transmitting and for receiving. For example, the pair of antennas may be time multiplexed for transmitting and for receiving.

Moreover, in some embodiments, at least some of the components that allow the polarization of the antenna radiation pattern to be dynamically adjusted may be included or integrated into a radome.

Note that dynamically changing or adjusting the polarization may not increase the gain of the antenna radiation pattern. Instead, the dynamically changed or adjusted polarization may reduce or eliminate the effect of a fading null at one polarization and/or a change in the polarization because of reflections.

Furthermore, note that the preceding embodiments may include fewer or additional components, two or more components may be combined into a single component, and/or positions of one or more components may be changed.

In some embodiments, a given antenna may be or may include a monopole or a dipole (such as a bent dipole antenna) or a slot antenna. For example, a dipole antenna may have a horizontal polarization and a slot antenna may have a vertical polarization. However, a wide variety of types of antennas and/or antenna elements may be used. The antennas may be free-standing and/or may be implemented on a substrate or a printed-circuit board (e.g., FR4, Rogers 4003, or another dielectric material), such as by using metal or another radio-frequency conducting foil on one side of the substrate and a ground plane on the other (coplanar) side of the substrate. Moreover, one or more additional components may be optionally included on either or both sides of the substrate. Note that the given antenna may have a polarization substantially in a plane of the substrate.

Moreover, the dimensions of the individual components in the given antenna may be established by use of radio-frequency simulation software, such as IE3D from Zeland Software of Fremont, Calif. In some embodiments, the given antenna may include one or more additional components, such as passive components that implement phase or impedance matching, that change a resonance frequency, that broaden the frequency response (or bandwidth), etc. For example, in the 2.4 to 2.4835 GHz band of frequencies, the frequency response of a dipole may be between 300-500 MHz.

Furthermore, switching at radio frequency (as opposed to baseband) may allow the access point to have fewer up/down converters and may simplify impedance matching between the interface circuit and the antennas. For example, a given antenna may provide an impedance match under all configurations of selected antenna elements, regardless of which antenna elements are selected. In some embodiments, a match with less than 10 dB return loss may be maintained under all configurations of selected antenna elements, over the range of frequencies (such as a band of frequencies in an IEEE 802.11 standard), regardless of which antenna elements are selected.

Alternatively or additionally to using antenna elements to vary the antenna radiation pattern, in some embodiments the communication techniques may be used in conjunction with beamforming. Note that the changes in the antenna radiation pattern and/or the beamforming may be used during transmission and/or receiving.

We now describe embodiments of an electronic device, which may perform at least some of the operations in the communication techniques. For example, the electronic device may include a component in system 110, such as one of: the one or more access points 112, the one or more electronic devices 114 and/or the one or more optional controllers 116. FIG. 8 presents a block diagram illustrating an electronic device 800 in accordance with some embodiments. This electronic device includes processing subsystem 810, memory subsystem 812, and networking subsystem 814. Processing subsystem 810 includes one or more devices configured to perform computational operations. For example, processing subsystem 810 can include one or more microprocessors, ASICs, microcontrollers, programmable-logic devices, graphical processor units (GPUs) and/or one or more digital signal processors (DSPs).

Memory subsystem 812 includes one or more devices for storing data and/or instructions for processing subsystem 810 and networking subsystem 814. For example, memory subsystem 812 can include dynamic random access memory (DRAM), static random access memory (SRAM), and/or other types of memory (which collectively or individually are sometimes referred to as a 'computer-readable storage medium'). In some embodiments, instructions for processing subsystem 810 in memory subsystem 812 include: one or more program modules or sets of instructions (such as program instructions 822 or operating system 824), which may be executed by processing subsystem 810. Note that the one or more computer programs may constitute a computer-program mechanism. Moreover, instructions in the various program instructions in memory subsystem 812 may be implemented in: a high-level procedural language, an object-oriented programming language, and/or in an assembly or machine language. Furthermore, the programming language may be compiled or interpreted, e.g., configurable or configured (which may be used interchangeably in this discussion), to be executed by processing subsystem 810.

In addition, memory subsystem 812 can include mechanisms for controlling access to the memory. In some embodiments, memory subsystem 812 includes a memory hierarchy that comprises one or more caches coupled to a memory in electronic device 800. In some of these embodiments, one or more of the caches is located in processing subsystem 810.

In some embodiments, memory subsystem 812 is coupled to one or more high-capacity mass-storage devices (not shown). For example, memory subsystem 812 can be coupled to a magnetic or optical drive, a solid-state drive, or another type of mass-storage device. In these embodiments, memory subsystem 812 can be used by electronic device 800 as fast-access storage for often-used data, while the mass-storage device is used to store less frequently used data.

Networking subsystem 814 includes one or more devices configured to couple to and communicate on a wired and/or wireless network (i.e., to perform network operations), including: control logic 816, an interface circuit 818 and one or more antennas 820 (or antenna elements). (While FIG. 8 includes one or more antennas 820, in some embodiments electronic device 800 includes one or more nodes, such as nodes 808, e.g., a pad, which can be coupled to the one or more antennas 820. Thus, electronic device 800 may or may not include the one or more antennas 820.) For example, networking subsystem 814 can include a Bluetooth networking system, a cellular networking system (e.g., a 3G/4G/5G network such as UMTS, LTE, etc.), a USB networking system, a networking system based on the standards described in IEEE 802.11 (e.g., a Wi-Fi networking system), an Ethernet networking system, and/or another networking system.

In some embodiments, a transmit antenna radiation pattern of electronic device 800 may be adapted or changed using pattern shapers (such as reflectors) in one or more antennas 820 (or antenna elements), which can be independently and selectively electrically coupled to ground to steer the transmit antenna radiation pattern in different directions. (The antenna-radiation-pattern shapers may be different from the directors and the reflectors discussed previously.) Thus, if one or more antennas 820 includes N antenna-radiation-pattern shapers, the one or more antennas 820 may have $2^N$ different antenna-radiation-pattern configurations. More generally, a given antenna radiation pattern may include amplitudes and/or phases of signals that specify a direction of the main or primary lobe of the given antenna radiation pattern, as well as so-called 'exclusion regions' or 'exclusion zones' (which are sometimes referred to as 'notches' or 'nulls'). Note that an exclusion zone of the given antenna radiation pattern includes a low-intensity region of the given antenna radiation pattern. While the intensity is not necessarily zero in the exclusion zone, it may be below a threshold, such as 4 dB or lower than the peak gain of the given antenna radiation pattern. Thus, the given antenna radiation pattern may include a local maximum (e.g., a primary beam) that directs gain in the direction of an electronic device that is of interest, and one or more local minima that reduce gain in the direction of other electronic devices that are not of interest. In this way, the given antenna radiation pattern may be selected so that communication that is undesirable (such as with the other electronic devices) is avoided to reduce or eliminate adverse effects, such as interference or crosstalk.

Networking subsystem 814 includes processors, controllers, radios/antennas, sockets/plugs, and/or other devices used for coupling to, communicating on, and handling data and events for each supported networking system. Note that mechanisms used for coupling to, communicating on, and handling data and events on the network for each network system are sometimes collectively referred to as a 'network interface' for the network system. Moreover, in some embodiments a 'network' or a 'connection' between the electronic devices does not yet exist. Therefore, electronic device 800 may use the mechanisms in networking subsystem 814 for performing simple wireless communication between the electronic devices, e.g., transmitting frames and/or scanning for frames transmitted by other electronic devices.

Within electronic device 800, processing subsystem 810, memory subsystem 812, and networking subsystem 814 are coupled together using bus 828. Bus 828 may include an electrical, optical, and/or electro-optical connection that the subsystems can use to communicate commands and data among one another. Although only one bus 828 is shown for clarity, different embodiments can include a different number or configuration of electrical, optical, and/or electro-optical connections among the subsystems.

In some embodiments, electronic device 800 includes a display subsystem 826 for displaying information on a display, which may include a display driver and the display, such as a liquid-crystal display, a multi-touch touchscreen, etc.

Electronic device 800 can be (or can be included in) any electronic device with at least one network interface. For example, electronic device 800 can be (or can be included in): a desktop computer, a laptop computer, a subnotebook/netbook, a server, a computer, a mainframe computer, a cloud-based computer, a tablet computer, a smartphone, a cellular telephone, a smartwatch, a consumer-electronic device, a portable computing device, an access point, a transceiver, a controller, a radio node, a router, a switch, communication equipment, an access point, test equipment, and/or another electronic device.

Although specific components are used to describe electronic device 800, in alternative embodiments, different components and/or subsystems may be present in electronic device 800. For example, electronic device 800 may include one or more additional processing subsystems, memory subsystems, networking subsystems, and/or display subsystems. Additionally, one or more of the subsystems may not be present in electronic device 800. Moreover, in some embodiments, electronic device 800 may include one or more additional subsystems that are not shown in FIG. 8. Also, although separate subsystems are shown in FIG. 8, in some embodiments some or all of a given subsystem or component can be integrated into one or more of the other subsystems or component(s) in electronic device 800. For example, in some embodiments program instructions 822 is included in operating system 824 and/or control logic 816 is included in interface circuit 818.

Moreover, the circuits and components in electronic device 800 may be implemented using any combination of analog and/or digital circuitry, including: bipolar, PMOS and/or NMOS gates or transistors. Furthermore, signals in these embodiments may include digital signals that have approximately discrete values and/or analog signals that have continuous values. Additionally, components and circuits may be single-ended or differential, and power supplies may be unipolar or bipolar.

An integrated circuit (which is sometimes referred to as a 'communication circuit' or a 'means for communication') may implement some or all of the functionality of networking subsystem 814. The integrated circuit may include hardware and/or software mechanisms that are used for transmitting wireless signals from electronic device 800 and receiving signals at electronic device 800 from other electronic devices. Aside from the mechanisms herein described, radios are generally known in the art and hence are not described in detail. In general, networking subsystem 814 and/or the integrated circuit can include any number of radios. Note that the radios in multiple-radio embodiments function in a similar way to the described single-radio embodiments.

In some embodiments, networking subsystem 814 and/or the integrated circuit include a configuration mechanism (such as one or more hardware and/or software mechanisms) that configures the radio(s) to transmit and/or receive on a given communication channel (e.g., a given carrier frequency). For example, in some embodiments, the configuration mechanism can be used to switch the radio from monitoring and/or transmitting on a given communication channel to monitoring and/or transmitting on a different communication channel. (Note that 'monitoring' as used herein comprises receiving signals from other electronic devices and possibly performing one or more processing operations on the received signals)

In some embodiments, an output of a process for designing the integrated circuit, or a portion of the integrated circuit, which includes one or more of the circuits described herein may be a computer-readable medium such as, for example, a magnetic tape or an optical or magnetic disk. The computer-readable medium may be encoded with data structures or other information describing circuitry that may be physically instantiated as the integrated circuit or the portion of the integrated circuit. Although various formats may be used for such encoding, these data structures are commonly written in: Caltech Intermediate Format (CIF), Calma GDS II Stream Format (GDSII) or Electronic Design Interchange Format (EDIF). Those of skill in the art of integrated circuit design can develop such data structures from schematics of the type detailed above and the corresponding descriptions and encode the data structures on the computer-readable medium. Those of skill in the art of integrated circuit fabrication can use such encoded data to fabricate integrated circuits that include one or more of the circuits described herein.

While the preceding discussion used Wi-Fi and/or Ethernet communication protocols as illustrative examples, in other embodiments a wide variety of communication protocols and, more generally, communication techniques may be used. Thus, the communication techniques may be used in a variety of network interfaces. Furthermore, while some of the operations in the preceding embodiments were implemented in hardware or software, in general the operations in the preceding embodiments can be implemented in a wide variety of configurations and architectures. Therefore, some or all of the operations in the preceding embodiments may be performed in hardware, in software or both. For example, at least some of the operations in the communication techniques may be implemented using program instructions 822, operating system 824 (such as a driver for interface circuit 818) or in firmware in interface circuit 818. Alternatively or additionally, at least some of the operations in the communication techniques may be implemented in a physical layer, such as hardware in interface circuit 818.

Moreover, while the preceding embodiments illustrated the use of wireless signals in one or more bands of frequencies, in other embodiments of these signals may be communicated in one or more bands of frequencies, including: a microwave frequency band, a radar frequency band, 900 MHz, 2.4 GHz, 5 GHz, 6 GHz, 60 GHz, and/or a band of frequencies used by a Citizens Broadband Radio Service or by LTE. In some embodiments, the communication between electronic devices uses multi-user transmission (such as orthogonal frequency division multiple access or OFDMA).

Furthermore, while the preceding embodiments illustrated the communication techniques with an access point, in other embodiments the communication techniques may be used with a wide variety of electronic devices, including: a desktop computer, a laptop computer, a subnotebook/netbook, a server, a computer, a mainframe computer, a cloud-based computer, a tablet computer, a smartphone, a cellular telephone, a smartwatch, a consumer-electronic device, a portable computing device, a transceiver, a controller, a radio node (e.g., an eNodeB), a router, a switch, communication equipment, a base station, test equipment, and/or another electronic device.

In the preceding description, we refer to 'some embodiments.' Note that 'some embodiments' describes a subset of all of the possible embodiments, but does not always specify the same subset of embodiments. Moreover, note that numerical values in the preceding embodiments are illustrative examples of some embodiments. In other embodiments of the communication techniques, different numerical values may be used.

The foregoing description is intended to enable any person skilled in the art to make and use the disclosure, and is provided in the context of a particular application and its requirements. Moreover, the foregoing descriptions of embodiments of the present disclosure have been presented for purposes of illustration and description only. They are not intended to be exhaustive or to limit the present disclosure to the forms disclosed. Accordingly, many modifications and variations will be apparent to practitioners skilled in the art, and the general principles defined herein may be applied to other embodiments and applications without departing from the spirit and scope of the present disclosure. Additionally, the discussion of the preceding embodiments is not intended to limit the present disclosure. Thus, the present disclosure is not intended to be limited to the embodiments shown, but is to be accorded the widest scope consistent with the principles and features disclosed herein.

What is claimed is:

1. An electronic device, comprising:

an antenna having an antenna radiation pattern;

an interface circuit communicatively coupled to the antenna; and an antenna cover comprising an integrated static lens, wherein the antenna cover is selected, based at least in part on a deployment geometry or a location of the electronic device, from a set of antenna covers and at least a pair of antenna covers in the set of antenna covers comprise different integrated static lenses from each other, wherein the interface circuit is configured to:

transmit, from the antenna, wireless signals corresponding to a packet or a frame, wherein the integrated static lens is configured to modify the antenna radiation pattern of the antenna.

2. The electronic device of claim 1, wherein the antenna comprises antenna elements and the interface circuit is configured to dynamically adjust the antenna radiation pattern by selectively electrically coupling at least one of the antenna elements to ground.

3. The electronic device of claim 1, wherein the electronic device comprises directors or reflectors, and the interface circuit is configured to dynamically adjust the antenna radiation pattern by selectively electrically coupling at least one of the directors or the reflectors to ground.

4. The electronic device of claim 1, wherein the integrated static lens is configured to cause the wireless signals to: converge, diverge, or change an angular elevation of the antenna radiation pattern.

5. The electronic device of claim 1, wherein the antenna comprises multiple antennas or multiple antenna elements at different locations in the electronic device; and wherein the integrated static lens is configured to provide a phase correction over the antennas or the antenna elements.

6. The electronic device of claim 5, wherein the phase correction is based at least in part on locations of the antennas or the antenna elements.

7. The electronic device of claim 1, wherein the integrated static lens is configured to provide a correction for pathloss as a function of angle.

8. The electronic device of claim 1, wherein the integrated static lens corresponds to a cosecant squared pattern.

9. The electronic device of claim 1, wherein the integrated static lens is a stepwise approximation to a predefined function.

10. The electronic device of claim 1, wherein the electronic device is configured to dynamically adjust a polarization of the wireless signals.

11. The electronic device of claim 10, wherein the interface circuit is configured to receive, at the antenna, feedback about communication of the packet or the frame associated with a second electronic device; and wherein the dynamic adjusting of the polarization is based at least in part on the feedback.

12. The electronic device of claim 1, wherein the antenna comprises multiple antennas or multiple antenna elements having different predefined polarizations, and the interface circuit is configured to dynamically select the antennas or the antenna elements to adjust a polarization of the wireless signals.

13. The electronic device of claim 12, wherein the interface circuit is configured to adjust the polarization of the wireless signals by changing a relative phase of electrical signals provided to at least some of the antennas.

14. The electronic device of claim 12, wherein the interface circuit is configured to receive, at one or more of the antennas or the antenna elements, feedback about communication of the packet or the frame associated with a second electronic device; and wherein the dynamic adjusting of the polarization is based at least in part on the feedback.

15. The electronic device of claim 1, wherein the interface circuit is configured to receive, at the antenna, second wireless signals corresponding to a second packet or a second frame.

16. A method for communicating a packet or a frame, comprising:

by an electronic device:

transmitting, from an antenna in the electronic device, wireless signals corresponding to the packet or the frame; and modifying, using an integrated static lens in an antenna cover in the electronic device, an antenna radiation pattern of the antenna, wherein the antenna cover is selected, based at least in part on a deployment geometry or a location of the electronic device, from a set of antenna covers and at least a pair of antenna covers in the set of antenna covers comprise different integrated static lenses from each other.

17. The method of claim 16, wherein the antenna comprises multiple antennas or multiple antenna elements at different locations in the electronic device; and wherein the integrated static lens provides a phase correction over the antennas or the antenna elements.

18. An electronic device, comprising:

an antenna having an antenna radiation pattern;

an interface circuit communicatively coupled to the antenna; and an antenna cover comprising an integrated static lens, wherein the antenna cover is selected, based at least in part on a deployment geometry or a location of the electronic device, from a set of antenna covers and at least a pair of antenna covers in the set of antenna covers comprise different integrated static lenses from each other, wherein the interface circuit is configured to:

receive, at the antenna, wireless signals corresponding to a packet or a frame, wherein the integrated static lens is configured to modify the antenna radiation pattern of the antenna.

19. The electronic device of claim 18, wherein the antenna comprises multiple antennas or multiple antenna elements at different locations in the electronic device; and wherein the integrated static lens provides a phase correction over the antennas or the antenna elements.

20. The electronic device of claim 18, wherein the electronic device comprises directors or reflectors, and the interface circuit is configured to dynamically adjust the antenna radiation pattern by selectively electrically coupling at least one of the directors or the reflectors to ground.

* * * * *